US011667134B2

(12) United States Patent
Asai et al.

(10) Patent No.: US 11,667,134 B2
(45) Date of Patent: Jun. 6, 2023

(54) PRINTING DEVICE

(71) Applicant: BROTHER KOGYO KABUSHIKI KAISHA, Nagoya (JP)

(72) Inventors: Sho Asai, Ama (JP); Yushi Kato, Nagoya (JP); Masashi Tanizaki, Kuwana (JP); Koshiro Shimoda, Tokoname (JP); Shotaro Watanabe, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/215,281

(22) Filed: Mar. 29, 2021

(65) Prior Publication Data

US 2021/0387464 A1 Dec. 16, 2021

(30) Foreign Application Priority Data

Jun. 11, 2020 (JP) ..... JP2020-101830

(51) Int. Cl.

| | |
|---|---|
| ***B41J 11/04*** | (2006.01) |
| ***B41J 29/02*** | (2006.01) |
| ***B41J 3/36*** | (2006.01) |
| ***B41J 3/407*** | (2006.01) |

(52) U.S. Cl.

CPC ..... *B41J 3/4075* (2013.01); *B41J 3/36* (2013.01); *B41J 11/04* (2013.01); *B41J 29/023* (2013.01)

(58) Field of Classification Search

CPC ... B41J 11/04; B41J 29/023; B41J 3/36; B41J 3/4075

See application file for complete search history.

(56) References Cited

U.S. PATENT DOCUMENTS

| | | | | |
|---|---|---|---|---|
| 9,090,109 | B1 | 7/2015 | Jo et al. | |
| 2006/0162842 | A1* | 7/2006 | Hiroike | B65C 11/0289 156/352 |
| 2019/0039388 | A1* | 2/2019 | Katayama | B41J 3/4075 |

FOREIGN PATENT DOCUMENTS

| | | | |
|---|---|---|---|
| JP | 2015-160662 | A | 9/2015 |

* cited by examiner

*Primary Examiner* — Christopher E Mahoney
*Assistant Examiner* — Kendrick X Liu
(74) *Attorney, Agent, or Firm* — Kenealy Vaidya LLP

(57) ABSTRACT

A printing device includes: a main body including an accommodating portion configured to accommodate a printing medium; a cover displaceable between an open position where the accommodation portion is opened and a closed position where the accommodation portion is closed; a platen roller attached to the cover and rotatably supported by the cover; a peeling roller attached to the cover and supported so as to be rotatable about an axis parallel to a longitudinal direction of the platen roller; and a switching mechanism attached to the cover and configured to switch the peeling roller between a contact position where the peeling roller comes into contact with the platen roller and a non-contact position where the peeling roller is away from the platen roller in conjunction with displacement of the cover.

6 Claims, 8 Drawing Sheets

PRINTING DEVICE

CROSS-REFERENCE TO RELATED APPLICATIONS

This application claims priority from Japanese Patent Application No. 2020-101830 filed on Jun. 11, 2020, the entire contents of which are incorporated herein by reference.

TECHNICAL FIELD

The present disclosure relates to a printing device.

BACKGROUND

A related-art printing device includes a main body, a cover, a platen roller, and a peeling mechanism. The main body can accommodate a printing medium having a label attached to a mount. The cover can be opened and closed with respect to the main body. The platen roller conveys the printing medium. The peeling mechanism includes a peeling roller. The peeling mechanism sandwiches the mount between the peeling roller and the platen roller and conveys the mount to bend the mount such that a surface of the mount to which no label is attached faces each other. Accordingly, the peeling mechanism peels off the printed label from the mount The printing device is used between a normal mode and a peeling mode by switching a position of the peeling mechanism with respect to the platen roller. In the normal mode, the printed label is discharged in a state of being attached to the mount. In the peeling mode, the printed label is discharged in a state of being peeled off from the mount.

When the printing device is used in the peeling mode, a user needs to manually move the position of the peeling mechanism each time opening and closing the cover with respect to the main body, which is troublesome.

SUMMARY

An object of the present disclosure is to provide a printing device capable of simplifying an operation of opening and closing a cover with respect to a main body as compared with the related art without manually switching a position of a peeling mechanism when used in a peeling mode.

According to an aspect of the present disclosure, a printing device includes: a main body including an accommodating portion configured to accommodate a printing medium; a cover displaceable between an open position where the accommodation portion is opened and a closed position where the accommodation portion is closed; a platen roller attached to the cover and rotatably supported by the cover; a peeling roller attached to the cover and supported so as to be rotatable about an axis parallel to a longitudinal direction of the platen roller; and a switching mechanism attached to the cover and configured to switch the peeling roller between a contact position where the peeling roller comes into contact with the platen roller and a non-contact position where the peeling roller is away from the platen roller in conjunction with displacement of the cover.

According to the printing device of this aspect, since the printing device includes the switching mechanism, a user does not need to manually switch a position of the peeling roller when opening and closing the cover. Therefore, when the printing device is used in the peeling mode, an operation of opening and closing the cover with respect to the main body is simpler than that in the related art.

DETAILED DESCRIPTION

Hereinafter, an embodiment of the present disclosure will be described with reference to the drawings. A printing device 1 can be connected to an external terminal (not shown) by wireless communication. The printing device 1 can print characters such as characters and figures on a printing medium M based on printing data received from the external terminal. The printing medium M is, for example, a thermal label attached to a mount, and is rolled around a tubular core. The external terminal is, for example, a general-purpose personal computer (PC). The printing device 1 can be battery-powered. The printing device 1 is carried and used by a working user, for example, by being mounted on a waist belt via a belt clip (not shown). A lower right side, an upper left side, an upper right side, a lower left side, an upper side and a lower side in FIGS. 1A and 1B are respectively defined as a right side, a left side, a rear side, a front side, an upper side and a lower side of the printing device 1.

Figure 1A:
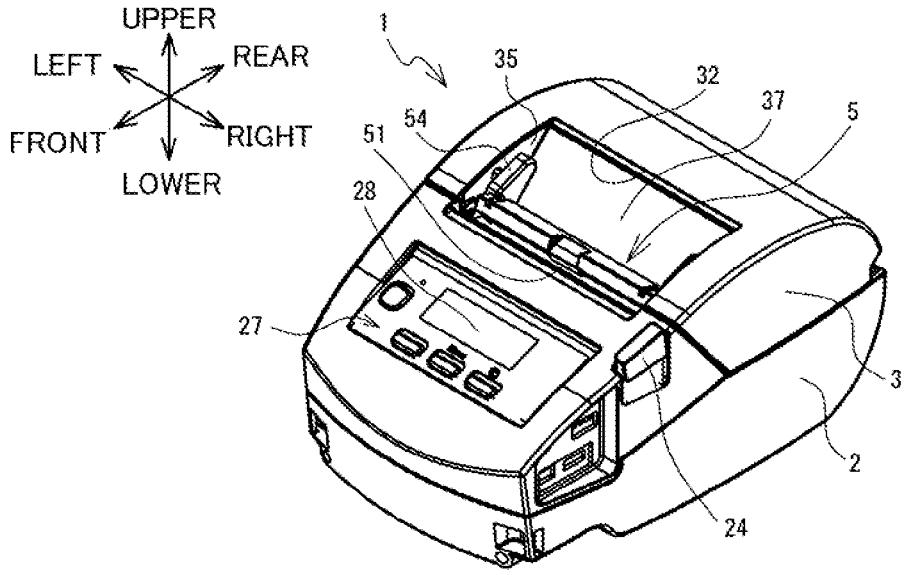
FIG. 1A is a perspective view of a printing device 1 in which a first platen unit 4 and a peeling unit 5 are mounted on a cover 3, and in which the cover 3 is in a closed position.
Figure 1B:
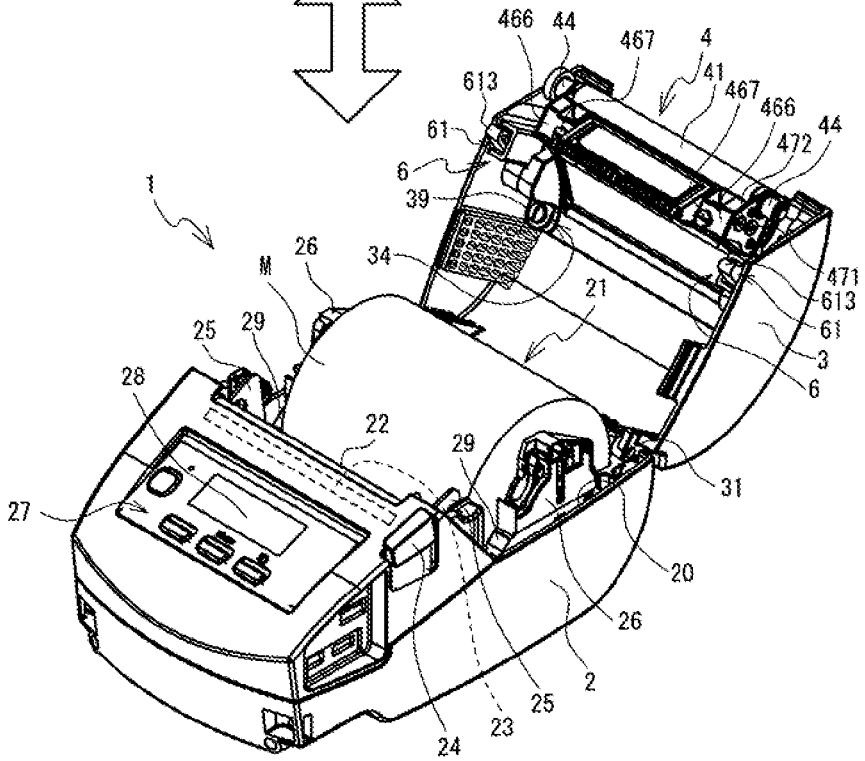
FIG. 1B is a perspective view of the printing device 1 in which the first platen unit 4 and the peeling unit 5 are mounted on the cover 3, and in which the cover 3 is in an open position.

As shown in FIGS. 1A and 1B, the printing device 1 includes a main body 2, a cover 3, a first platen unit 4, a peeling unit 5 and switching mechanisms 6. The main body 2 has a substantially rectangular parallelepiped box shape with an open rear portion. The main body 2 includes an opening 20 and an accommodation portion 21. The opening 20 is a portion that opens upward in the rear portion of the main body 2. The accommodation portion 21 is a recessed portion that can accommodate the printing medium M.

In the printing device 1, the main body 2 includes a cutting blade 22, a thermal head 23, a lever 24, a pair of locking portions 25, a pair of support portions 26, an input portion 27 and a display portion 28. The cutting blade 22 is provided at a front end portion of the opening 20 of the main body 2. The cutting blade 22 can separate a printed portion of the printing medium M. The thermal head 23 is provided below the cutting blade 22. The thermal head 23 prints a character on the thermal label by heating. The cutting blade 22 and the thermal head 23 extend in a left-right direction.

The lever 24 is provided at a center of a right side surface of the main body 2. The pair of locking portions 25 are provided at both left and right end portions of the opening 20 of the main body 2. A lower end portion of each locking portion 25 is swingably supported. When the lever 24 is pushed down by the user, an upper end portion of each locking portion 25 swings rearward.

The pair of support portions 26 are disposed at both left and right end portions of the accommodation portion 21 and face each other in the left-right direction. The pair of support portions 26 support both sides of the printing medium M in the left-right direction. Front end portions of the pair of support portions 26 are contact portions 29, each of which can come into contact with an end portion 613 of a first member 61 described later. The input portion 27 and the display portion 28 are provided on an upper surface of a front portion of the main body 2. The input portion 27 includes a plurality of switches, and can input various instructions. The display portion 28 is a liquid crystal display long in the left-right direction, and can display various types of information.

Figure 2:
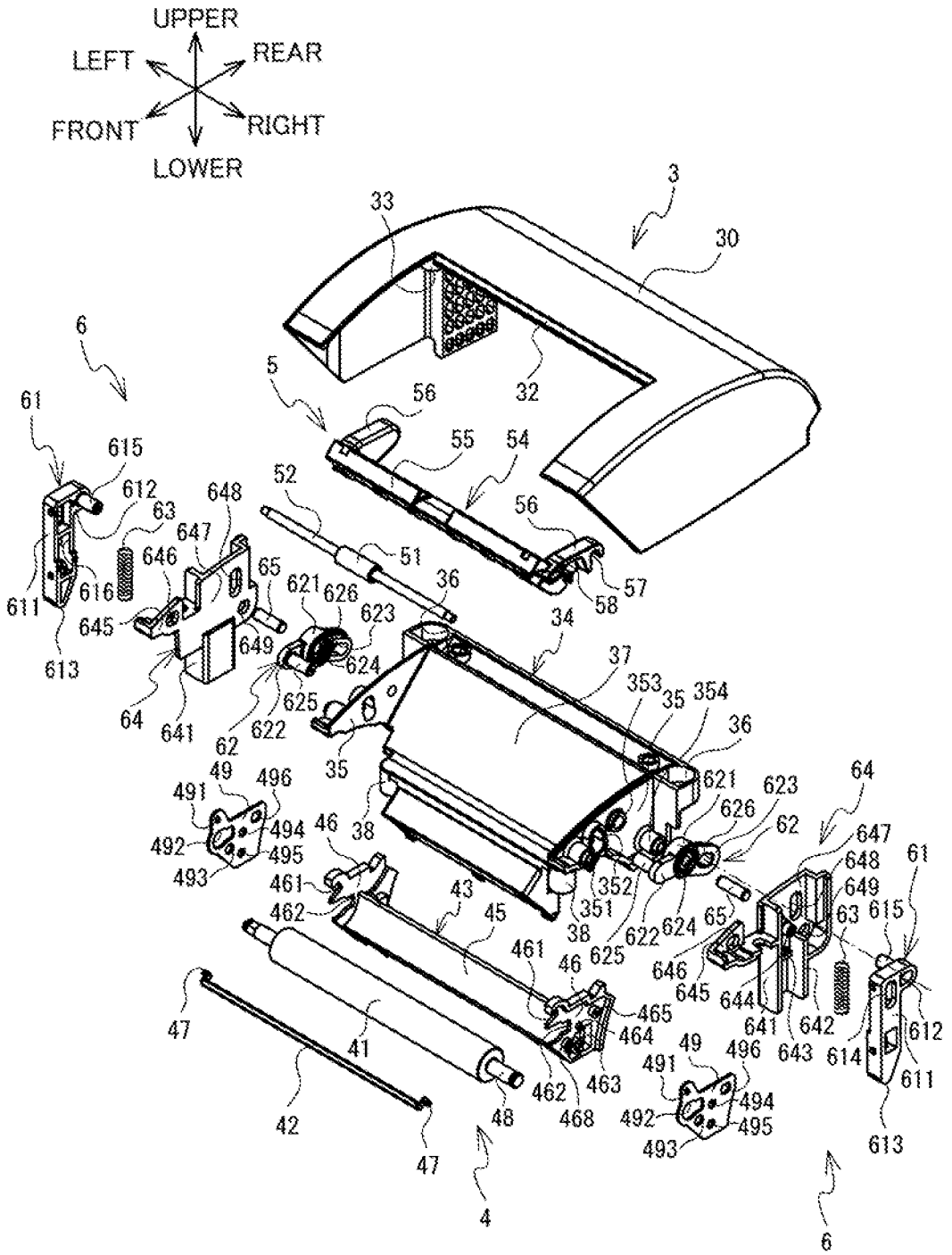
FIG. 2 is an exploded perspective view of the cover 3, the first platen unit 4, the peeling unit 5 and switching mechanisms 6.

The cover 3 is swingably supported by a support shaft 31 extending in the left-right direction at a rear upper end portion of the main body 2. The cover 3 is displaceable between a closed position shown in FIG. 1A where the accommodation portion 21 is closed and an open position shown in FIG. 1B where the accommodation portion 21 is opened. Hereinafter, a configuration of the cover 3 will be described with reference to a state in which the cover 3 is in the closed position. As shown in FIG. 2, the cover 3 includes a cover main body 30 and a guide member 34. The cover main body 30 has an inverted U shape in a plan view; and includes a recessed portion 32 and a pair of protruding portions 33. The recessed portion 32 is a portion recessed rearward from a front end portion of the cover 3. The pair of protruding portions 33 are provided in portions of a lower surface of the cover 3 at a rear side of left and right ends of the recessed portion 32, and protrudes downward. Each protruding portion 33 has a screw hole extending upward from a lower end thereof.

As shown in FIGS. 1 to 4, the guide member 34 includes an inclined surface 37, a pair of left and right tubular portions 36, a pair of left and right side wall portions 35 and a pair of left and right mounting portions 38. The inclined surface 37 is a flat surface inclined upward toward the rear, and guides the printed printing medium M when the printed printing medium M is discharged to outside of the printing device 1. Each of the pair of left and right tubular portions 36 has a bottomed tubular shape, and has a hole on the bottom portion penetrating in an upper-lower direction. The pair of left and right tubular portions 36 are respectively provided at a rear side of left and right ends of the inclined surface 37. Each of the pair of left and right tubular portions 36 is fitted to the corresponding protruding portion 33. The guide member 34 is fixed to the lower surface of the cover main body 30 by screws 39 inserted into holes of the tubular portions 36 and screw holes of the recessed portions 33.

Each of the pair of left and right side wall portions 35 extends forward from left and right ends of the inclined surface 37. In a state in which the guide member 34 is fixed to the cover 3, upper ends of the pair of left and right side wall portions 35 and a rear end of the inclined surface 37 come into contact with a periphery of the recessed portion 32 in a lower surface of the cover main body 30. The pair of left and right side wall portions 35 are configured to be bilaterally symmetrical to each other. Hereinafter, a configuration of the right side wall portion 35 will be described, and description of the left side wall portion 35 will be omitted. The right side wall portion 35 includes protruding portions 351, 354, a hole 352 and a tubular rib 353. The protruding portion 351 protrudes rightward in a tubular shape at a front end portion on a right surface of the right side wall portion 35. The protruding portion 354 protrudes rightward in a tubular shape at a rear lower end portion on the right surface of the right side wall portion 35. Each of the protruding portions 351, 354 has a screw hole extending leftward from a right end thereof. The hole 352 is a long hole extending in the upper-lower direction behind the protruding portion 351 and penetrating in the left-right direction. The tubular rib 353 has an annular shape and protrudes rightward from the right side wall portion 35, and a through hole penetrating in the left-right direction is provided in a center thereof. A shaft 65 described later is inserted into the through hole of the tubular rib 353. In a state in which the shaft 65 is inserted into the through hole of the tubular rib 353, a right end of the shaft 65 protrudes rightward from a right end of the tubular rib 353, and a left end of the shaft 65 protrudes leftward from a left side surface of the right side wall portion 35. The pair of left and right mounting portions 38 are tubular portions provided at end portions of a front end portion of the inclined surface 37 in the left-right direction and extending downward. Each of the pair of left and right mounting portions 38 has a screw hole extending from the lower side to the upper side.

The first platen unit 4 and the peeling unit 5 are detachably mounted on the cover 3. The first platen unit 4 is detachably mounted on the lower surface of the cover 3 in vicinity of the front end portion of the cover 3. The first platen unit 4 includes a platen roller 41, a peeling plate 42 and a support member 43. The platen roller 41 is formed in a tubular shape on an outer circumference of a rotation shaft 48 extending in the left-right direction. The platen roller 41 is made of resin, for example, and the rotation shaft 48 is made of metal, for example. A length of the platen roller 41 in the left-right direction is longer than half a length of the rotation shaft 48 in the left-right direction. Cylindrical bearings 44 are fitted to both left and right end portions of the rotation shaft 48. When the cover 3 is disposed in the closed position, each bearing 44 is locked by the corresponding locking portion 25. In this case, the cover 3 is maintained in the closed position. When the lever 24 is pushed down while the cover 3 is in the closed position, the corresponding locking portion 25 is disengaged from each bearing 44. At this time, the cover 3 swings about the support shaft 31 from the closed position to the open position by a biasing force of a spring (not shown) externally inserted into the support shaft 31.

Figure 4A:
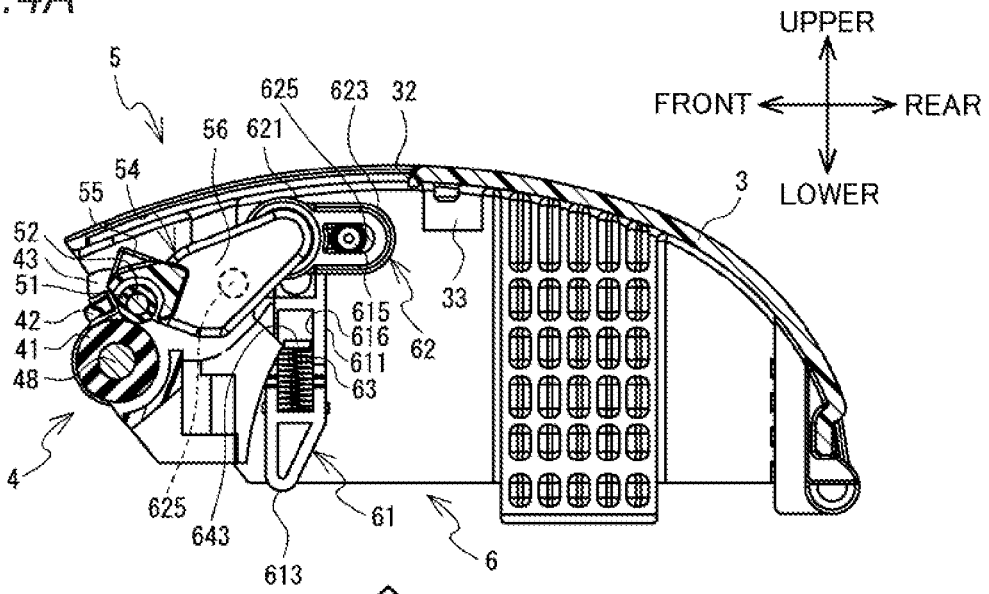
FIG. 4A is a cross-sectional view taken along a line C-C in FIG. 5A, which shows the first platen unit 4, the peeling unit 5 and the switching mechanism 6 when the cover 3 is in the closed position.

The peeling plate 42 has a plate shape extending parallel to a longitudinal direction of the platen roller 41. The peeling plate 42 is away from the platen roller 41 and a peeling roller 51, and disposed above the platen roller 41. A pair of left and right end portions 47 of the peeling plate 42 are bent rearward. As shown in FIG. 4A, a position of the peeling plate 42 in a front-rear direction when the cover 3 is in the closed position is between a front end of the platen roller 41 and a center of the platen roller 41 in the front-rear direction. A position of a lower end of the peeling plate 42 in the upper-lower direction is substantially the same as a position of an upper end of the platen roller 41 in the upper-lower direction.

Figure 3:
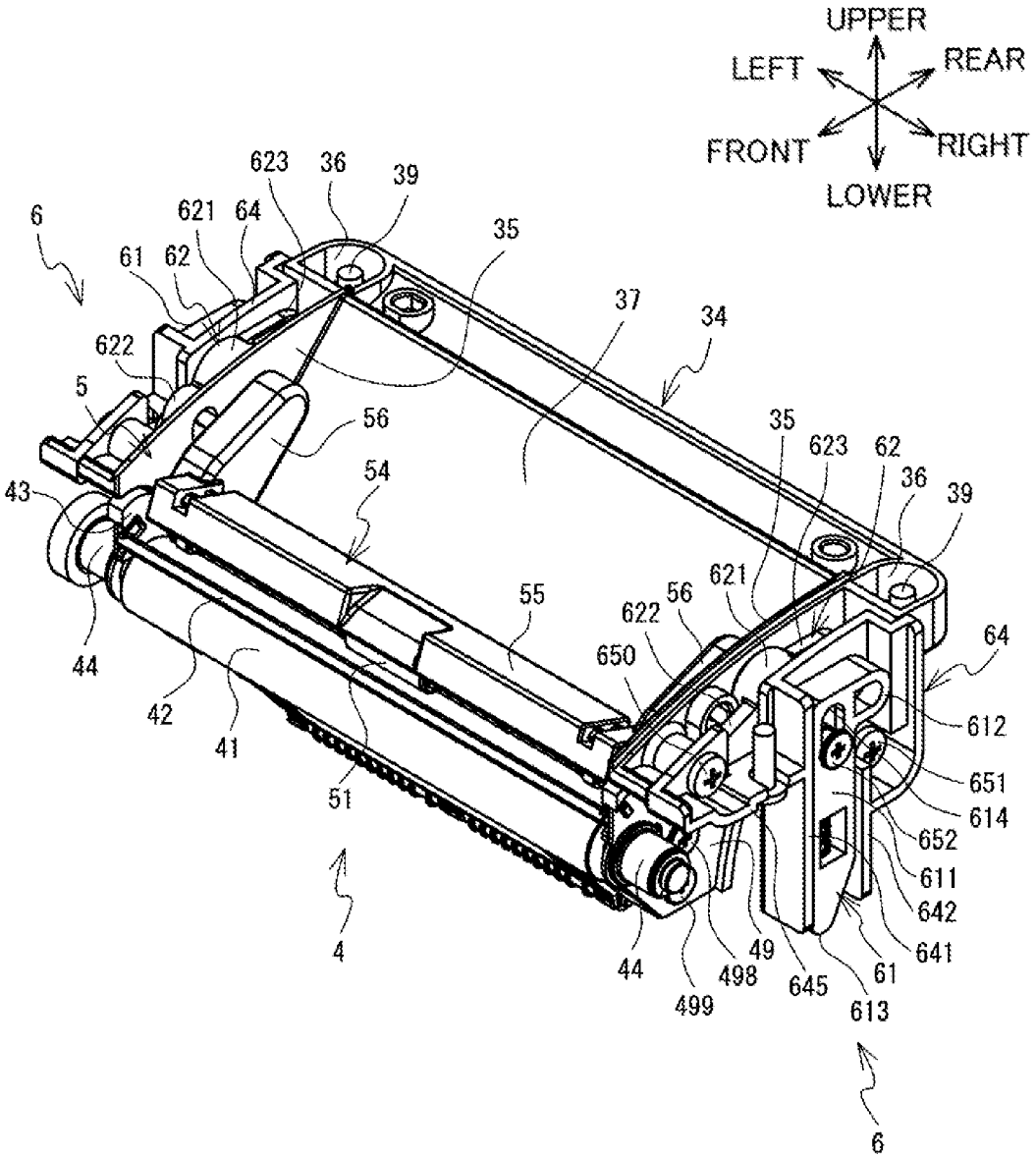
FIG. 3 is a perspective view of a guide member 34, the first platen unit 4, the peeling unit 5 and the switching mechanisms 6.

As shown in FIGS. 2 to 4, the support member 43 rotatably supports the platen roller 41, supports the peeling plate 42, and is detachably supported by the cover 3. The support member 43 includes a coupling portion 45, a pair of left and right side wall portions 46 and a pair of left and right fixing plates 49. The coupling portion 45 has a plate shape extending in the left-right direction and curved along an outer circumference of the platen roller 41. A left end of the coupling portion 45 is coupled to a front lower portion of the left side wall portion 46, and a right end of the coupling portion 45 is coupled to a front lower portion of the right side wall portion 46.

The pair of left and right side wall portions 46 each have a plate shape extending perpendicularly to the left-right direction. The pair of left and right side wall portions 46 are configured to be bilaterally symmetrical to each other. Hereinafter, a configuration of the right side wall portion 46 will be described, and description of a configuration of the left side wall portion 46 will be omitted. The right side wall portion 46 includes recessed portions 461, 462, holes 463, 464, protruding portions 465, 468, and a mounting portion 466 (see FIG. 1B). The recessed portion 461 is recessed rearward from a front upper end of the right side wall portion 46. The recessed portion 462 is recessed rearward from a front end of the right side wall portion 46 below the recessed portion 461. A recessed amount of the recessed portion 461 is smaller than a recessed amount of the recessed portion 462. Each of the holes 463, 464 is a screw hole extending in the left-right direction. The holes 463, 464 are arranged in the upper-lower direction in a central portion of the right side wall portion 46 in the front-rear direction. Each of the protruding portions 465, 468 protrudes rightward from a right surface of the right side wall portion 46 in a cylindrical shape. The protruding portion 465 is provided at an upper rear portion of the right surface of the right side wall portion 46, and the protruding portion 468 is provided at a lower front portion of the right surface of the right side wall portion 46. The mounting portion 466 extends leftward from a lower portion of a left surface of the right side wall portion 46. The mounting portion 466 has a hole extending upward from a lower end. The first platen unit 4 is inserted into the holes of the mounting portions 466, and is detachably fixed to inside of the pair of left and right side wall portions 35 of the guide member 34 by screws 467 (see FIG. 1B) fastened to the screw hole of the right mounting portion 38. When detaching the first platen unit 4 from the cover 3, the user releases fastening of the screws 467.

The pair of left and right fixing plates 49 have the same configuration. Hereinafter, a configuration of the right fixing plate 49 will be described, and description of a left fixing plate 49 will be omitted. The right fixing plate 49 has a plate shape extending perpendicularly to the left-right direction. The right fixing plate 49 includes holes 491 to 496 penetrating in the left-right direction. The hole 491 is provided in a front upper portion of the right fixing plate 49, and has a rectangular shape in a side view. The hole 492 is provided below the hole 491 and has an elliptical shape long in the left-right direction in the side view. The hole 493 is provided below the hole 492 and has a circular shape in the side view. The holes 494, 495 are provided in a central portion of the right fixing plate 49 in the front-rear direction and are arranged in the upper-lower direction. The holes 494, 495 are circular in the side view. The hole 496 is provided in a rear upper portion of the right fixing plate 49, and has an elliptical shape long in the left-right direction in the side view.

The first platen unit 4 is formed by assembling the platen roller 41, the peeling plate 42 and the support member 43 as follows. Both end portions of the rotation shaft 48 of the platen roller 41 in the left-right direction are respectively disposed in the recessed portions 462 of the corresponding side wall portions 46. The pair of right and left end portions 47 of the peeling plate 42 are respectively disposed in the recessed portions 461 of the corresponding side wall portions 46. The right fixing plate 49 is disposed on a right side of the right side wall portion 46. The bearing 44 fitted to the right end of the rotation shaft 48 is inserted into and held by the hole 492 of the right fixing plate 49. The right end portion 47 of the peeling plate 42 is inserted into the hole 491 of the right fixing plate 49. The protruding portion 465 of the right side wall portion 46 is inserted into the hole 496. The protruding portion 468 is inserted into the hole 493. The right fixing plate 49 is fixed to the right side wall portion 46 by a screw 471 and a screw 472 (see FIG. 1B). The screw 471 is inserted into the hole 494 and fastened to the hole 464. The screw 472 is inserted into the hole 495 and fastened to the hole 463. Similarly, the left fixing plate 49 is disposed on a left side of the left side wall portion 46 and is fixed to the left side wall portion 46.

The peeling unit 5 is detachably mounted on the lower surface of the cover 3 above the first platen unit 4. The peeling unit 5 includes the peeling roller 51 and a first mounting member 54. The peeling roller 51 is provided in a tubular shape on an outer circumference of a rotation shaft 52 extending in parallel with the longitudinal direction of the platen roller 41. The peeling roller 51 is provided at a center of the rotation shaft 52 in the longitudinal direction. A length of the peeling roller 51 in the left-right direction is shorter than half a length of the rotation shaft 52 in the left-right direction. An extension range of the peeling roller 51 in the left-right direction is narrower than an extension range of the platen roller 41 in the left-right direction. The peeling roller 51 is made of resin, for example, and the rotation shaft 52 is made of metal, for example.

The first mounting member 54 rotatably supports the peeling roller 51 about the rotation shaft 52 parallel to the longitudinal direction of the platen roller 41. The first mounting member 54 is swingably and detachably mounted on the cover 3. The first mounting member 54 is made of resin, for example. The first mounting member 54 includes a coupling portion 55 and a pair of left and right side wall portions 56. The coupling portion 55 has a rod shape extending in the left-right direction. A left end portion of the coupling portion 55 is coupled to a front upper portion of the left side wall portion 56. A right end portion of the coupling portion 55 is coupled to a front upper portion of the right side wall portion 56. The pair of left and right side wall portions 56 have structures that are bilaterally symmetrical to each other. Hereinafter, a structure of the right side wall portion 56 will be described, and description of the left side wall portion 56 will be omitted. The right side wall portion 56 has a triangular shape extending in the front-rear direction with rounded angles in the side view. The right side wall portion 56 includes recessed portions 57, 58. The recessed portion 57 is recessed upward from a rear lower end portion of the right side wall 56. The recessed portion 58 is recessed upward from a lower end portion of the right side wall portion 56 in front of the recessed portion 57. The left end of the shaft 65 inserted into the through hole of the tubular rib 353 is engaged with the recessed portion 57. A pin 625 described later is engaged with the recess portion 58. Thereby, the peeling unit 5 is mounted on the lower surface of the cover 3 and above the first platen unit 4 so as to be detachable from the cover 3 and swingable about the shaft 65. When detaching the peeling unit 5 from the cover 3, the user bends the pair of left and right side wall portions 56 of the first mounting member 54 inward to disengage the recessed portions 57, 58 from the shaft 65 and the pin 625.

Figure 4B:
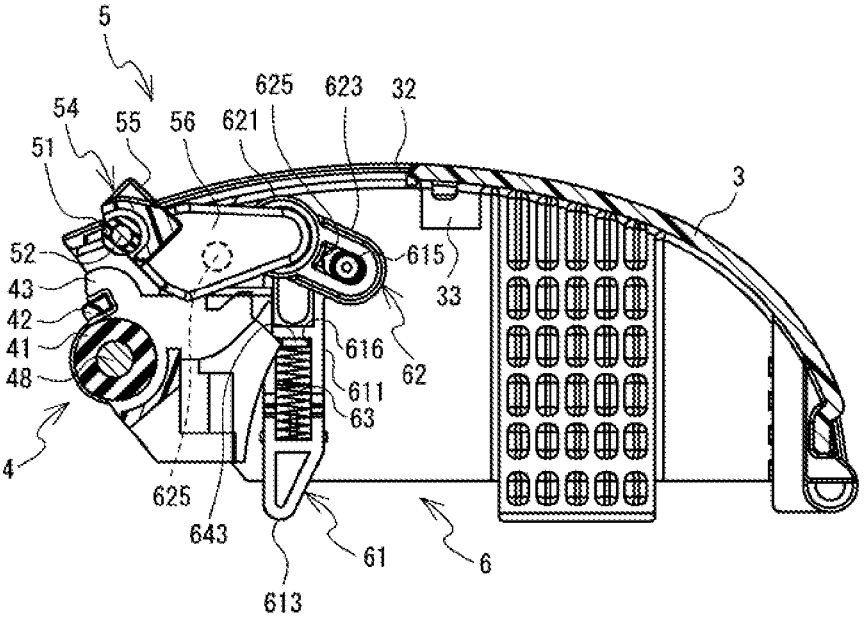
FIG. 4B is a cross-sectional view taken along the line C-C in FIG. 5A, which shows the first platen unit 4, the peeling unit 5 and the switching mechanism 6 when the cover 3 is in the open position.

A pair of left and right switching mechanisms 6 are attached to the cover 3, and switch the peeling roller 51 between a contact position where the peeling roller 51 comes into contact with the platen roller 41 (see FIG. 4A) and a non-contact position where the peeling roller 51 is away from the platen roller 41 (see FIG. 4B) in conjunction with displacement of the cover 3. Specifically, the peeling roller 51 is located in the contact position when the cover 3 is in the closed position, and the peeling roller 51 is located in the non-contact position when the cover 3 is in the open position. Each of the pair of left and right switching mechanisms 6 is mounted on the side wall portion 35 of the guide member 34 in the cover 3. The pair of left and right switching mechanisms 6 are configured to be bilaterally symmetrical to each other. Hereinafter, a configuration of the right switching mechanism 6 will be described, and description of the left switching mechanism 6 will be omitted. In FIGS. 4A and 4B, for the sake of simplicity, a posture (an orientation) when the cover 3 is in the closed position and a posture (an orientation) when the cover 3 is in the open position are shown so as to match each other, and a configuration of each member and an operation of switching the peeling roller 51 between the contact position and the non-contact position will be described. In FIGS. 4A and 4B, the guide member 34 and an attachment base 64 described later are not shown.

The switching mechanism 6 includes the first member 61, a biasing member 63, the attachment base 64, a second member 62 and the shaft 65. The first member 61 is a member having a P-shape long in the upper-lower direction in a side view. When the cover 3 is displaced from the open position to the closed position, the first member 61 comes into contact with the contact portion 29 of the main body 2 to move in a first direction with respect to the cover 3. The first direction according to the present embodiment is a longitudinal direction of the first member 61. When the cover 3 is in the closed position, the first direction is upward. The first member 61 includes a main body 611 and a protruding portion 612. The main body 611 has a box shape long in the upper-lower direction and including a recessed portion 616 recessed from the left side to the right side (only the left switching mechanism 6 is shown). The main body 611 includes a long hole 614 long in the upper-lower direction and penetrating an upper end portion of a right surface of the main body 611 in the left-right direction. The protruding portion 612 protrudes rearward from an upper portion of a rear surface of the main body 611. The protruding portion 612 includes a pin 615 protruding leftward. The biasing member 63 biases the first member 61 in a second direction opposite to the first direction. The biasing member 63 is a compression coil spring, for example. The biasing member 63 is disposed in the recessed portion 616 of the main body 611 in a posture of being compressed in the upper-lower direction.

The attachment base 64 guides movement of the first member 61 in the longitudinal direction. The attachment base 64 includes a wall portion 647, guide walls 641, 642, a plate portion 643, a protruding portion 644, a mounting portion 645 and holes 648, 649. The wall portion 647 has a plate shape extending perpendicularly to the left-right direction. Each of the guide walls 641, 642 is coupled to a right surface of the wall portion 647, and has a plate shape long in the upper-lower direction and extending perpendicularly to the front-rear direction. The main body 611 of the first member 61 is disposed between the guide walls 641, 642 in the front-rear direction. The plate portion 643 is provided between the guide walls 641, 642, and has a plate shape extending rightward from vicinity of a center of the right surface of the wall portion 647. A lower surface of the plate portion 643 is in contact with an upper end of the biasing member 63 disposed on the main body 611. The protruding portion 644 protrudes rightward from the right surface of the wall portion 647 above the plate portion 643. The mounting portion 645 extends forward from an upper portion of the front guide wall 641. The mounting portion 645 has a hole 646 penetrating in the left-right direction. The holes 648, 649 are provided behind the rear guide wall 642 in the wall portion 647. The hole 648 is a long hole long in the upper-lower direction in the side view. The hole 649 has a circular shape in the side view and is provided below the hole 648. The attachment base 64 is fixed to a right side wall portion 35 of the guide member 34 by a screw 650 inserted into the hole 646 (see FIG. 3) and a screw 651 inserted into the hole 649 (see FIG. 3). When the main body 611 of the first member 61 is disposed between the guide walls 641, 642, the pin 615 is inserted into the hole 648. The protruding portion 644 is inserted into the long hole 614 of the main body 611 from the left side. A screw 652 (see FIG. 3) is fixed to a hole of the protruding portion 644, and thus, the first member 61 is supported so as to be movable in the longitudinal direction without being detached from the attachment base 64.

The second member 62 is swingably supported by the cover 3. The second member 62 includes a tubular portion 621, a front portion 622 and a rear portion 623. The tubular portion 621 has a tubular shape having a hole 624 penetrating in the left-right direction. The shaft 65 is inserted through the hole 624. The second member 62 is rotatably supported by the guide member 34 by the shaft 65. The front portion 622 has a plate shape extending forward from a front side surface of the tubular portion 621. A left surface of the front portion 622 includes a pin 625 protruding leftward. The pin 625 is inserted into the hole 352 of the right side wall portion 35 of the guide member 34. As shown in FIG. 5B, a left end of the pin 625 protrudes leftward from a left surface of the right side wall portion 35. When the peeling unit 5 is mounted on the cover 3, the left end of the pin 625 is disposed in the recessed portion 58 of the first mounting member 54. The rear portion 623 extends rearward from a rear side surface of the tubular portion 621. The rear portion 623 includes a hole 624 extending in a longitudinal direction of the rear portion 623. The longitudinal direction of the rear portion 623 is a radial direction radially extending around the tubular portion 621. The pin 615 of the first member 61 is inserted into the hole 624 from the right side. The second member 62 is coupled to the first member 61 via the pin 615.

The second member 62 is coupled to the first member 61 and the first mounting member 54 that rotatably supports the peeling roller 51. When the first member 61 moves in the longitudinal direction of the first member 61 with respect to the cover 3 against a biasing force of the biasing member 63, the peeling roller 51 is moved from the non-contact position shown in FIG. 4B to the contact position shown in FIG. 4A via the first mounting member 54. As shown in FIG. 4B, when the peeling roller 51 is in the non-contact position, a center of the peeling roller 51 in the upper-lower direction is located forward than the tubular portion 621, and the pin 615 is located rearward and downward than the tubular portion 621. A distance between the platen roller 41 and the peeling roller 51 is longer than a diameter of the peeling roller 51. A lower end of the peeling roller 51 is located above an upper end of the peeling plate 42. As shown in FIG. 4A, when the peeling roller 51 is in the contact position, the center of the peeling roller 51 in the upper-lower direction is located forward and downward than the tubular portion 621, and the pin 615 is located rearward than the tubular portion 621. The lower end of the peeling roller 51 is located below the upper end of the peeling plate 42. The peeling roller 51 is located behind the peeling plate 42.

An operation of opening and closing the cover 3 in the printing device 1 in which the peeling unit 5 and the first platen unit 4 are mounted on the cover 3 will be described. The user pushes down the lever 24 to displace the cover 3 from the closed position to the open position (open the cover 3). When the user displaces the cover 3 from the closed position to the open position, the user does not need to change a position of the peeling unit 5 with respect to the cover 3. Even when the cover 3 is displaced, a position of the platen roller 41 with respect to the cover 3 does not change. A position of the peeling roller 51 with respect to the cover 3 is changed as the cover 3 is displaced from the closed position to the open position. Specifically, the end portion 613 of the first member 61 is away from the contact portion 29 of the main body 2, and the first member 61 moves in the longitudinal direction of the first member 61 with respect to the cover 3 (downward or away from an upper surface of the cover 3) by the biasing force of the biasing member 63. The pin 615 of the first member 61 moves from a position shown in FIG. 4A away from the upper surface of the cover 3 (downward), and the second member 62 rotates clockwise in the right side view. As the second member 62 rotates, the pin 625 of the second member 62 moves toward the upper surface (upward). As the pin 625 of the second member 62 moves, the peeling unit 5 rotates about the shaft 65 clockwise in the right side view. Thereby, the peeling roller 51 is moved from the contact position shown in FIG. 4A to the non-contact position shown in FIG. 4B. The user disposes the printing medium M in the accommodation portion 21 in a direction in which the printing medium M is rolled clockwise in the right side view.

The printing device 1 can be used in a peeling mode in which a printed label is peeled off from the mount by using the peeling roller 51, or in a normal mode in which the printed label remains attached to the mount without using the peeling roller 51. When the printing device 1 is used in the peeling mode, after disposing the printing medium M in the accommodation portion 21, the user pulls out one end portion of the printing medium M to insert the one end portion between the upper end of the peeling plate 42 and the lower end of the peeling roller 51 from a front side to a rear side of the peeling plate 42. When the printing device 1 is used in the normal mode, the user disposes the one end portion of the printing medium M in front of the peeling plate 42 and above the coupling portion 55 of the peeling unit 5. The user does not need to change the position of the peeling unit 5 with respect to the cover 3 when the printing device 1 is used in the peeling mode and when the printing device 1 is used in the normal mode.

Next, the user displaces the cover 3 from the open position to the closed position. That is, the user closes the cover 3. When the user displaces the cover 3 from the open position to the closed position, the user does not need to change the position of the peeling unit 5 with respect to the platen roller 41. Even when the cover 3 is displaced, the position of the platen roller 41 with respect to the cover 3 does not change. The position of the peeling roller 51 with respect to the cover 3 is changed as the cover 3 is displaced from the open position to the closed position. Specifically, the end portion 613 of the first member 61 comes into contact with the contact portion 29 of the main body 2, and moves in the longitudinal direction of the first member 61 with respect to the cover 3 (upward, or toward the upper surface of the cover 3) against the biasing force of the biasing member 63. The pin 615 of the first member 61 moves toward the upper surface of the cover 3 (upward), and the second member 62 rotates counterclockwise in the right side view. As the second member 62 rotates, the pin 625 of the second member 62 moves away from the upper surface of the cover 3 (downward). As the pin 625 of the second member 62 moves, the peeling unit 5 rotates about the shaft 65 counterclockwise in the right side view. Thereby, the peeling roller 51 is moved from the non-contact position shown in FIG. 4B to the contact position shown in FIG. 4A.

When the printing device 1 is used in the peeling mode, the peeling roller 51 in the contact position comes into contact with the printing medium M. When the printed printing medium M is conveyed, the label is peeled off from the mount bent by the peeling plate 42 due to own rigidity, is conveyed along a path passing above the coupling portion 55 of the peeling unit 5, and is discharged to the outside of the printing device 1. On the other hand, the mount is bent by the peeling plate 42, passes below the coupling portion 55 of the peeling unit 5, is conveyed along a path sandwiched between the platen roller 41 and the peeling roller 51, and is discharged to the outside of the printing device 1. When the printing device 1 is used in the normal mode, the peeling roller 51 in the contact position does not contact the printing medium M. The printing medium M is conveyed along the path passing above the coupling portion 55 of the peeling unit 5, and is discharged to the outside of the printing device 1. After displacing the cover 3 to the closed position, the user does not need to change the position of the peeling unit 5 with respect to the platen roller 41.

Figure 5A:
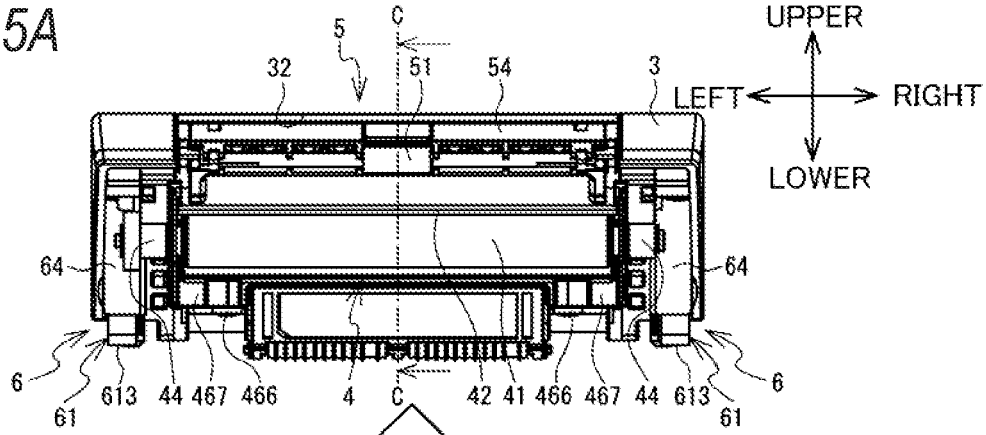
FIG. 5A is a front view of the cover 3 to which the first platen unit 4 and the peeling unit 5 are attached.
Figure 5B:
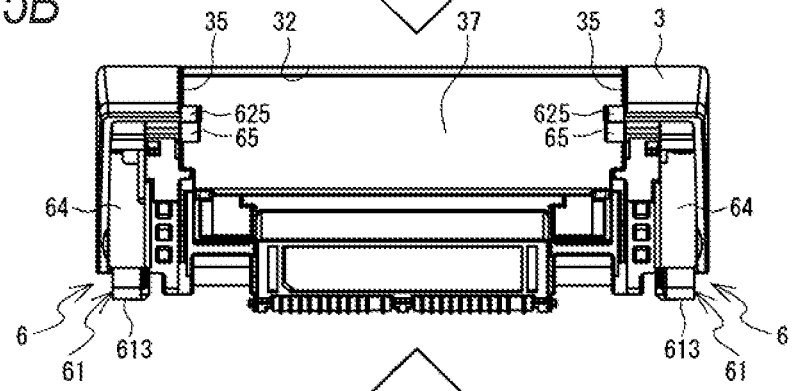
FIG. 5B is a front view of the cover 3 from which the first platen unit 4 and the peeling unit 5 are detached.
Figure 5C:
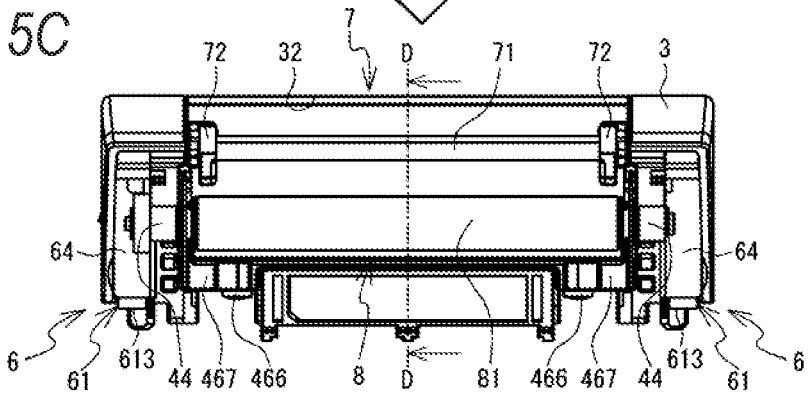
FIG. 5C is a front view of the cover 3 to which a regulation unit 7 and a second platen unit 8 are attached instead of the first platen unit 4 and the peeling unit 5.
Figure 6A:
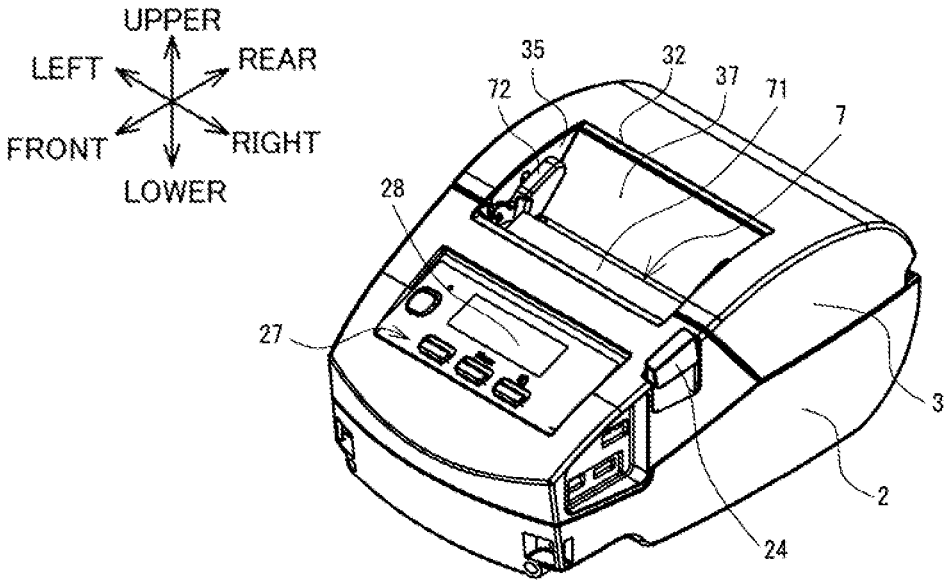
FIG. 6A is a perspective view of the printing device 1 in which the second platen unit 8 and the regulation unit 7 are mounted on the cover 3, and in which the cover 3 is in the closed position.
Figure 6B:
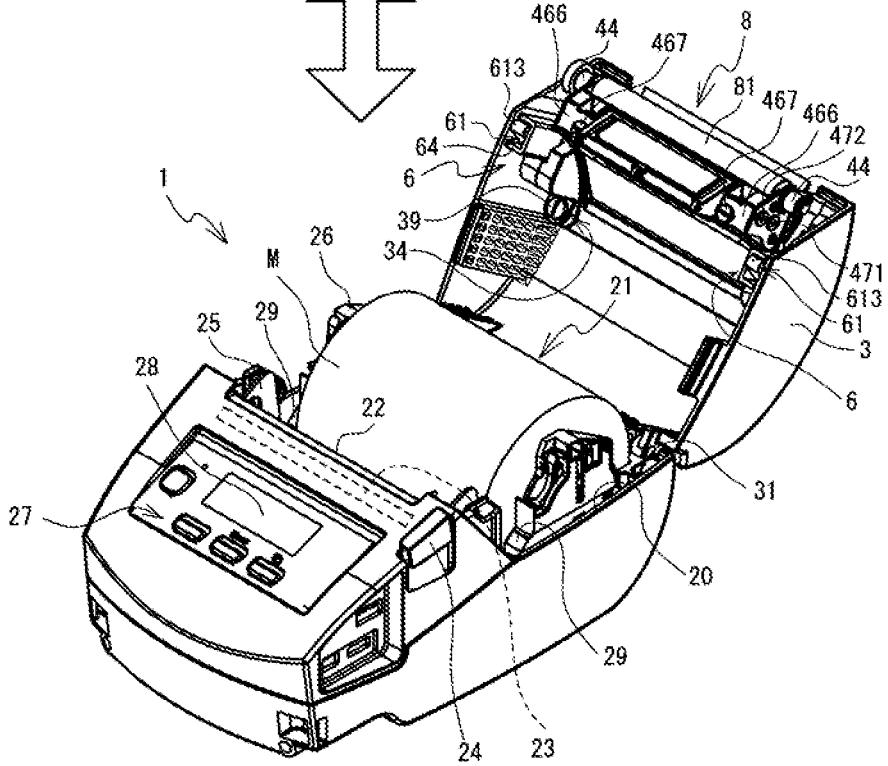
FIG. 6B is a perspective view of the printing device 1 in which the second platen unit 8 and the regulation unit 7 are mounted on the cover 3, and in which the cover 3 is in the open position.
Figure 7:
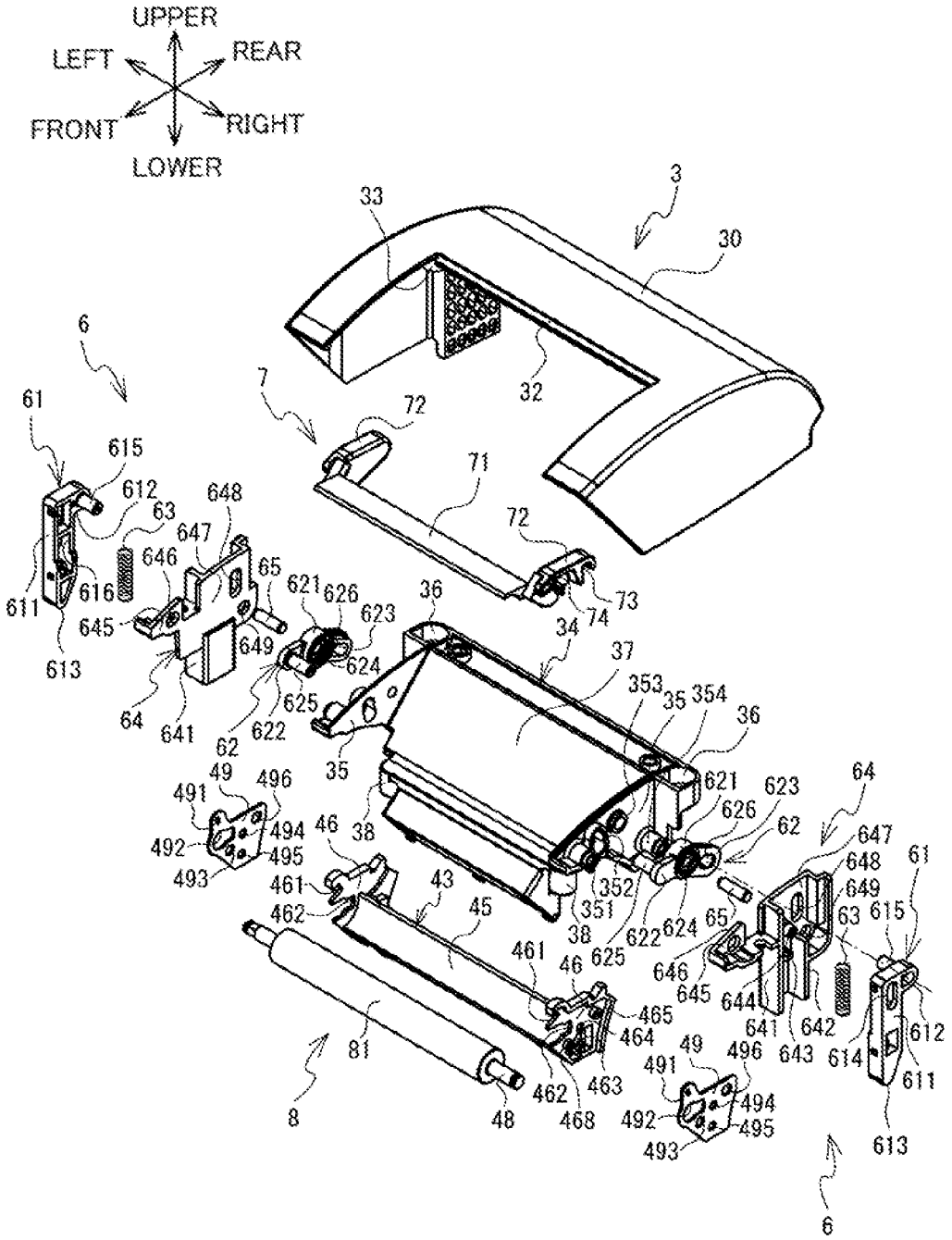
FIG. 7 is an exploded perspective view of the cover 3, the second platen unit 8, the regulation unit 7 and the switching mechanisms 6.

As shown in FIGS. 5A to 5C, in the printing device 1, a regulation unit 7 can be detachably mounted instead of the peeling unit 5, and a second platen unit 8 can be detachably mounted instead of the first platen unit 4. In FIGS. 5 to 8, the same components as those in a case where the peeling unit 5 and the first platen unit 4 are mounted are denoted by the same reference numerals. The regulation unit 7 is detachably mounted on the cover 3 when the peeling unit 5 is not mounted on the cover 3. For example, the regulation unit 7 is used when the printing medium M is a linerless label. The linerless label has an adhesive layer on a surface opposite to a printing surface, and does not include amount such as release paper. The linerless label is rolled in a roll shape in a direction in which the adhesive layer is disposed on a center side of a roll.

The regulation unit 7 includes a regulation member 71 and a pair of left and right second mounting members 72. The regulation member 71 has a plate shape extending along a longitudinal direction (the left-right direction) of a platen roller 81. A length of the regulation member 71 in the front-rear direction is shorter than a diameter of the platen roller 81 and longer than a radius of the platen roller 81. A surface of the regulation member 71 facing the platen roller 81 is curved in an arc shape along an outer circumference of the platen roller 81. A left end of the regulation member 71 is coupled to a front end portion of the left second mounting member 72. A right end of the regulation member 71 is coupled to a front end portion of the right second mounting member 72.

The second mounting members 72 are detachably coupled to the second member 62. The second mounting members 72 support the regulation member 71 such that the regulation member 71 is switchable between a close position where the regulation member 71 is close to the platen roller 41 with a predetermined gap therebetween and a retracted position where the regulation member 71 is farther from the platen roller 41 than the close position in conjunction with displacement of the cover 3. The second mounting members 72 are swingably and detachably mounted on the cover 3. The pair of right and left second mounting members 72 are configured to be bilaterally symmetrical to each other. Hereinafter, a configuration of the right second mounting member 72 will be described, and description of the left second mounting member 72 will be omitted. The right second mounting member 72 has a plate shape perpendicular to the left-right direction and extends in the front-rear direction. The right second mounting member 72 includes recessed portions 73, 74. The recessed portion 73 is recessed upward from a rear lower end portion of the right second mounting member 72. The recessed portion 74 is recessed upward from a lower end portion of the right second mounting member 72 in front of the recessed portion 73. The left end of the shaft 65 is engaged with the recessed portion 73. The pin 625 is engaged with the recessed portion 74. Thereby, the regulation unit 7 is mounted on the lower surface of the cover 3 and above the second platen unit 8 so as to be detachable from the cover 3 and swingable about the shaft 65. When detaching the regulation unit 7 from the cover 3, the user bends the pair of left and right second mounting members 72 inward to disengage the recessed portions 73, 74 from the shaft 65 and the pin 625.

Figure 8A:
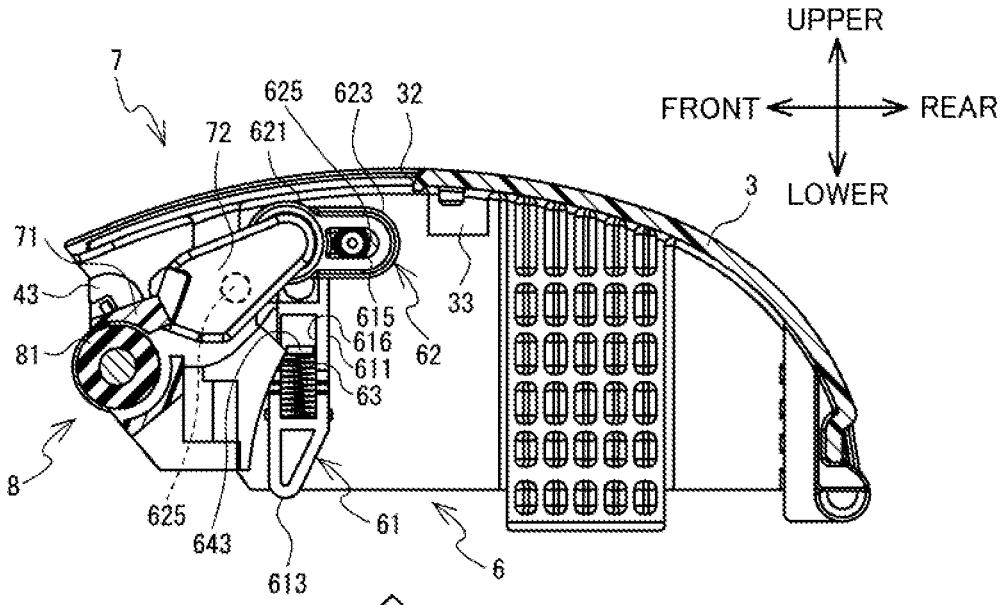
FIG. 8A is a cross-sectional view taken along a line D-D in FIG. 5C, which shows the second platen unit 8, the regulation unit 7 and the switching mechanism 6 when the cover 3 is in the closed position.
Figure 8B:
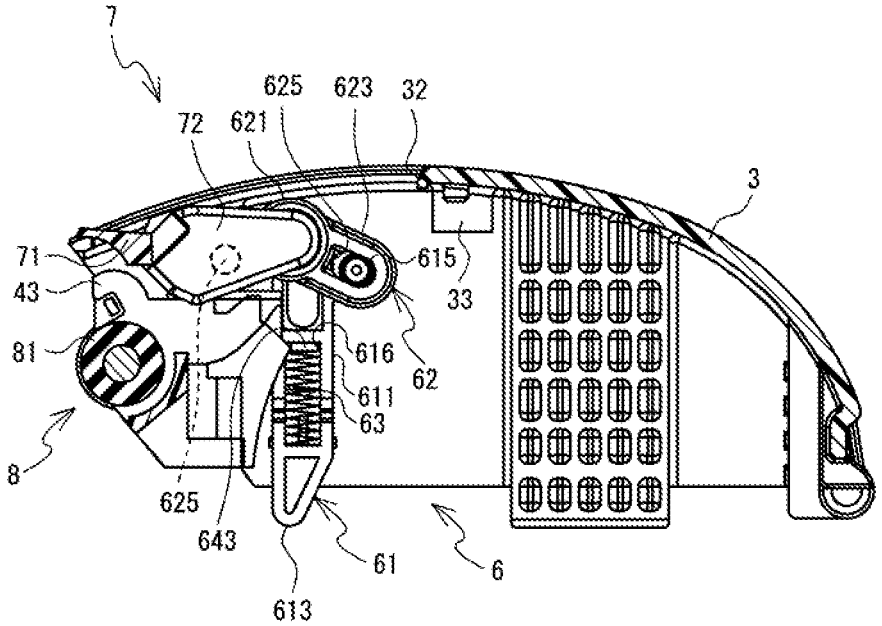
FIG. 8B is a cross-sectional view taken along the line D-D in FIG. 5C, which shows the second platen unit 8, the regulation unit 7 and the switching mechanism 6 when the cover 3 is in the open position.

Similarly to the peeling unit 5, in the regulation unit 7, the regulation member 71 moves from the close position shown in FIG. 8A to the retracted position shown in FIG. 8B in conjunction with displacement of the cover 3 from the closed position to the open position. When the regulation member 71 is disposed in the close position, the regulation member 71 prevents the printing medium M from being caught between the platen roller 41 and the regulation member 71. The printing medium M moves above the regulation member 71 disposed in the close position, and is discharged to the outside of the printing device 1.

The second platen unit 8 is detachably mounted on the cover 3 when the first platen unit 4 is not mounted on the cover 3. The second platen unit 8 includes the platen roller 81 and a support member 43 similar to the support member 43 of the first platen unit 4. The platen roller 81 is formed in a tubular shape on the outer circumference of the rotation shaft 48 extending in the left-right direction. Since the platen roller 81 comes into contact with the adhesive layer of the linerless label, the platen roller 81 is made of, for example, a resin having releasability higher than the resin forming the platen roller 41, and the rotation shaft 48 is made of metal, for example. A shape of the platen roller 81 is the same as that of the platen roller 41. The cylindrical bearings 44 are fitted to both left and right end portions of the rotation shaft 48. Similarly to the first platen unit 4, the support member 43 rotatably supports the platen roller 81 and is detachably supported by the cover 3. That is, the second platen unit 8 is inserted into the holes of the mounting portions 466, and is detachably fixed to the inside of the pair of left and right side wall portions 35 of the guide member 34 by the screws 467 fastened to the screw holes of the mounting portions 466. When detaching the second platen unit 8 from the cover 3, the user releases fastening of the screws 467.

An operation of opening and closing the cover 3 in the printing device 1 in which the regulation unit 7 and the second platen unit 8 are mounted on the cover 3 will be described. In FIGS. 8A and 8B, for the sake of simplicity, a posture (an orientation) when the cover 3 is in the closed position and a posture (an orientation) when the cover 3 is in the open position are shown to match each other. In FIGS. 8A and 8B, the guide member 34 and the attachment base 64 described later are not shown. The user pushes down the lever 24 to displace the cover 3 from the closed position to the open position (open the cover 3). When the user displaces the cover 3 from the closed position to the open position, the user does not need to change a position of the regulation unit 7 with respect to the platen roller 81. Even when the cover 3 is displaced, a position of the platen roller 81 with respect to the cover 3 does not change. A position of the regulation member 71 with respect to the cover 3 is changed as the cover 3 is displaced from the closed position to the open position. Specifically, as the pin 625 of the second member 62 moves, the regulation unit 7 rotates about the shaft 65 clockwise in the right side view. Thereby, the regulation member 71 is moved from the close position shown in FIG. 8A to the retracted position shown in FIG. 8B. When the printing medium M is caught between the regulation member 71 and the platen roller 81, the user can remove the printing medium M in a state where the regulation member 71 is disposed in the retracted position.

Next, the user displaces the cover 3 from the open position to the closed position (closes the cover 3). When the user displaces the cover 3 from the open position to the closed position, the user does not need to change the position of the regulation unit 7 with respect to the platen roller 81. Even when the cover 3 is displaced, the position of the platen roller 81 with respect to the cover 3 does not change. The position of the regulation member 71 with respect to the cover 3 is changed as the cover 3 is displaced from the open position to the closed position. Specifically, as the second member 62 rotates, the pin 625 of the second member 62 moves downward. As the pin 625 of the second member 62 moves, the regulation unit 7 rotates about the shaft 65 counterclockwise in the right side view. Thereby, the regulation member 71 is moved from the retracted position shown in FIG. 8B to the close position shown in FIG. 8A. After displacing the cover 3 to the closed position, the user does not need to change the position of the regulation unit 7 with respect to the cover 3. As described above, when the regulation unit 7 and the second platen unit 8 are mounted on the cover 3, the switching mechanisms 6 switch the position of the regulation member 71 in conjunction with the displacement of the cover 3 such that the regulation member 71 is located in the close position when the cover 3 is in the closed position and the regulation member 71 is located in the retracted position when the cover 3 is in the open position.

In the printing device 1 according to the above-described embodiment, the printing device 1, the main body 2, the accommodation portion 21, the cover 3, the peeling roller 51 and the switching mechanism 6 are respectively examples of a printing device, a main body, an accommodation portion, a cover, a peeling roller and a switching mechanism according to the present disclosure. The platen rollers 41, 81 are examples of a platen roller according the present disclosure. The first member 61, the second member 62 and the biasing member 63 are respectively examples of a first member, a second member and a biasing member. The first platen unit 4, the peeling plate 42, the peeling unit 5 and the first mounting member 54 are respectively examples of a first platen unit, a peeling plate, a peeling unit and a first mounting member according to the present disclosure. The support member 43 is an examples of a first support member and a second support member according to the present disclosure. The regulation unit 7, the second platen unit 8, the regulation member 71 and the second mounting member 72 are respectively examples of a regulation unit, a second platen unit, a regulation member and a second mounting member according to the present disclosure.

As shown in FIGS. 1 to 5, the printing device 1 according to the above embodiment includes the main body 2, the cover 3, the platen roller 41, the peeling roller 51, and the switching mechanisms 6. The main body 2 includes the accommodation portion 21 configured to accommodate the printing medium M. The cover 3 is displaceable between the open position where the accommodation portion 21 is opened (see FIG. 1B) and the closed position where the accommodation portion 21 is closed (see FIG. 1A). The platen roller 41 is attached to the cover 3 and is rotatably supported by the cover 3. The peeling roller 51 is attached to the cover 3 and is supported so as to be rotatable about an axis parallel to the longitudinal direction of the platen roller 41. The switching mechanism 6 is attached to the cover 3, and switch the peeling roller 51 between the contact position where the peeling roller 51 comes into contact with the platen roller 41 (see FIG. 4A) and the non-contact position where the peeling roller 51 is away from the platen roller 41 (see FIG. 4B) in conjunction with the displacement of the cover 3. Since the printing device 1 includes the switching mechanism 6, the user does not need to manually switch the position of the peeling roller 51 when opening and closing the cover 3. Therefore, when the printing device 1 is used in the peeling mode, the operation of opening and closing the cover 3 with respect to the main body 2 is easier than an operation according to related art.

The switching mechanism 6 includes the first member 61, the biasing member 63 and the second member 62. When the cover 3 is displaced from the open position to the closed position, the first member 61 comes into contact with the main body 2 to move in the first direction with respect to the cover 3. The biasing member 63 biases the first member 61 in the second direction opposite to the first direction. The second member 62 is swingably supported by the cover 3, is coupled to the first member 61 and the peeling roller 51, and moves the peeling roller 51 from the non-contact position to the contact position when the first member 61 moves in the first direction with respect to the cover 3 against the biasing force of the biasing member 63. In the printing device 1, the peeling roller 51 can be switched between the contact position and the non-contact position in conjunction with the displacement of the cover 3 by a relatively simple configuration including the first member 61, the biasing member 63 and the second member 62. Further, the printing device 1 includes the pair of left and right switching mechanisms 6, and moves both left and right end portions of the peeling roller 51 in conjunction with the displacement of the cover 3. Therefore, the printing device 1 can stably switch the peeling roller 51 between the contact position and the non-contact position in conjunction with the displacement of the cover 3, as compared with a case where the switching mechanism 6 is provided only at one of the left and right end portions of the peeling roller 51.

As shown in FIGS. 5 to 8, in the printing device 1, the peeling unit 5 and the first platen unit 4 can be detachably mounted on the cover 3. The peeling unit 5 includes the peeling roller 51 and the first mounting member 54. The first mounting member 54 is detachably coupled to the second member 62, rotatably supports the peeling roller 51, and is swingably and detachably mounted on the cover 3. The first platen unit 4 includes the platen roller 41, the peeling plate 42 and the support member 43. The peeling plate 42 is away from the platen roller 41 and the peeling roller 51, and extends in the longitudinal direction of the platen roller 41. The support member 43 rotatably supports the platen roller 41, supports the peeling plate 42, and is detachably supported by the cover 3. In the printing device 1, each of the peeling unit 5 and the first platen unit 4 can be detached from the cover 3. In the printing device 1, maintainability of the printing device 1 can be improved as compared with a device in which the peeling unit 5 and the first platen unit 4 are not detachable. In the printing device 1, a path of the printing medium M can be bent by the peeling plate 42 with a relatively simple configuration. In the printing device 1, since the peeling plate 42 is included in the first platen unit 4, the peeling plate 42 can be detached by detaching the first platen unit 4 from the printing device 1.

The regulation unit 7 is detachably mounted on the cover 3 when the peeling unit 5 is not mounted on the cover 3. The regulation unit 7 includes the regulation member 71 and the second mounting members 72. The regulation member 71 extends along the longitudinal direction of the platen roller 81. The second mounting members 72 are detachably coupled to the second member 62. The second mounting members 72 support the regulation member 71 such that the regulation member 71 is switchable between the close position where the regulation member 71 is close to the platen roller 41 with the predetermined gap therebetween and the retracted position where the regulation member 71 is farther from the platen roller 41 than the close position in conjunction with the displacement of the cover 3, and is swingably and detachably mounted on the cover 3. The second platen unit 8 is detachably mounted on the cover 3 when the first platen unit 4 is not mounted on the cover 3. The second platen unit 8 includes the platen roller 81 and the second support member 43. The second support member 43 rotatably supports the platen roller 81 and is detachably supported by the cover 3. The regulation member 71 moves from the close position to the retracted position in conjunction with the displacement of the cover 3 from the closed position to the open position. When the regulation member 71 is disposed in the close position, the regulation member 71 prevents the printing medium M from being caught between the platen roller 41 and the regulation member 71.

In the printing device 1, the regulation unit 7 and the second platen unit 8 are mounted on the cover 3 instead of the peeling unit 5 and the first platen unit 4, so that the printing device 1 can be used in a mode different from the peeling mode. Specifically, in a case of a mode in which printing is performed using the long linerless label having the adhesive layer on the surface opposite to the printing surface without including the mount instead of using the printing medium M having the label attached to the mount, the regulation member 71 peels off the linerless label attached to the platen roller 81 when the printing medium M is conveyed by the platen roller 81, and prevents the printing medium M from being caught in the gap between the regulation member 71 and the platen roller 81. However, for some reason, the linerless label may not be peeled off from the platen roller 81 and may enter the gap between the regulation member 71 and the platen roller 81 to cause clogging. In this case, when the user opens the cover 3, the regulation member 71 moves from the close position to the retracted position, and thus the gap between the regulation member 71 and the platen roller 81 is enlarged as compared with a case where the regulation member 71 is located in the close position. Thereby, the user can easily remove the clogging of the linerless label. In the printing device 1, the pair of switching mechanisms 6 can be shared by the peeling unit 5 and the regulation unit 7.

The printing device according to the present disclosure is not limited to the above-described embodiment, and various modifications may be made without departing from the scope of the present disclosure. For example, the following modifications may be appropriately made.

The shape, number, arrangement, material, mounting method and the like of the members constituting the printing device 1 may be appropriately changed. For example, arrangement of the cover 3 with respect to the main body 2, degree of opening and the like may be changed as appropriate. At least one of the first platen unit 4 and the peeling roller 51 may be undetachably supported by the cover 3. The peeling plate 42 may be attached to the peeling unit 5 instead of the first platen unit 4, or may be omitted. Configurations of the support members 43 of the first platen unit 4 and the second platen unit 8 may be different from each other. In the printing device 1, the regulation unit 7 and the second platen unit 8 may not be detachably mounted. In the printing device 1, the regulation unit 7 and the second platen unit 8 may be detachably mounted, and the peeling unit 5 and the first platen unit 4 may not be mounted. The configuration of the pair of left and right switching mechanisms 6 may be appropriately changed, and for example, the printing device 1 may include only one of the pair of left and right switching mechanisms 6. The switching mechanism 6 may not include the second member 62, and the pin 615 of the first member 61 may be directly coupled to the support member 43 behind a swing shaft of the support member 43. A moving direction of the first member 61 may be appropriately changed according to a configuration of the first member 61, a portion of the main body 2 with which the first member 61 comes into contact, and the like, and for example, the first direction may be on a support shaft 31 side (the right side) with respect to the first member 61.

What is claimed is:

1. A printing device comprising:

a main body including an accommodating portion configured to accommodate a printing medium;

a cover displaceable between an open position where the accommodation portion is opened and a closed position where the accommodation portion is closed;

a platen roller attached to the cover and rotatably supported by the cover;

a peeling roller attached to the cover and supported so as to be rotatable about an axis parallel to a longitudinal direction of the platen roller; and a switching mechanism attached to the cover and configured to switch the peeling roller between a contact position where the peeling roller comes into contact with the platen roller when the cover is closed and a non-contact position where the peeling roller is away from the platen roller when cover is opened, by moving the peeling roller with respect to the cover in conjunction with movement of the cover; and the moving the peeling roller includes that when the cover is closed, the switching mechanism, in response to the cover moving to the closed position, moves the peeling roller from the non-contact position to the contact position.

2. The printing device according to claim 1, wherein the switching mechanism includes:

a first member that comes into contact with the main body to move in a first direction with respect to the cover when the cover is displaced from the open position to the closed position;

a biasing member configured to bias the first member in a second direction opposite to the first direction; and a second member swingably supported by the cover and coupled to the first member and the peeling roller, the second member moving the peeling roller from the non-contact position to the contact position when the first member moves in the first direction with respect to the cover against a biasing force of the biasing member.

3. The printing device according to claim 2, further comprising:

a peeling unit detachably mounted on the cover, the peeling unit including:

the peeling roller; and a first mounting member detachably coupled to the second member, rotatably supporting the peeling roller, and swingably and detachably mounted on the cover; and a first platen unit detachably mounted on the cover, the first platen unit including:

the platen roller;

a peeling plate away from the platen roller and the peeling roller, and extending in the longitudinal direction of the platen roller; and a first support member rotatably supporting the platen roller, supporting the peeling plate, and detachably supported by the cover.

4. The printing device according to claim 3, further comprising:

a regulation unit detachably mounted on the cover when the peeling unit is not mounted on the cover, the regulation unit including:

a regulation member extending along the longitudinal direction of the platen roller; and a second mounting member detachably coupled to the second member, and supporting the regulation member such that the regulation member is switchable between a close position where the regulation member is close to the platen roller with a predetermined gap therebetween and a retracted position where the regulation member is farther from the platen roller than the close position in conjunction with the displacement of the cover, the second mounting member being swingably and detachably mounted on the cover; and a second platen unit detachably mounted on the cover when the first platen unit is not mounted on the cover, the second platen unit including:

the platen roller; and a second support member rotatably supporting the platen roller and detachably supported by the cover, wherein the regulation member is movable from the close position to the retracted position in conjunction with the displacement of the cover from the closed position to the open position, and wherein, when the regulation member is disposed in the close position, the regulation member prevents the printing medium from being caught between the platen roller and the regulation member.

5. The printing device according to claim 1, the switching mechanism including a biasing member, the biasing member configured to bias so that the peeling roller is biased away from the platen roller.

6. The printing device according to claim 1, wherein the switching mechanism moves the peeling roller from the non-contact position to the contact position includes:

the switching mechanism rotating the peeling roller from the non-contact position to the contact position.

* * * * *